US007670165B2

(12) United States Patent
Wu et al.

(10) Patent No.: US 7,670,165 B2
(45) Date of Patent: Mar. 2, 2010

(54) RESTRICTION MECHANISM FOR CARD

(75) Inventors: Chao-Chung Wu, Taipei (TW); Yu-Chen Lee, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 12/270,829

(22) Filed: Nov. 13, 2008

(65) Prior Publication Data

US 2009/0124110 A1 May 14, 2009

(30) Foreign Application Priority Data

Nov. 14, 2007 (TW) ..... 96143028 A

(51) Int. Cl.
*H01R 13/62* (2006.01)

(52) U.S. Cl. ..... 439/327

(58) Field of Classification Search ..... 439/327, 439/328, 304, 133, 325, 160, 157, 152, 155
See application file for complete search history.

(56) References Cited

U.S. PATENT DOCUMENTS 6,932,633 B2 * 8/2005 Tsai ..... 439/160

7,371,103 B2 * 5/2008 McGrath et al. ..... 439/352

FOREIGN PATENT DOCUMENTS

| | | |
|---|---|---|
| CN | 2587009 | 11/2003 |
| CN | 1501203 | 6/2004 |
| CN | 2867428 | 2/2007 |

* cited by examiner

*Primary Examiner*—Ross N Gushi
(74) *Attorney, Agent, or Firm*—Jianq Chyun IP Office

(57) ABSTRACT

A restriction mechanism for a card is provided. The card includes at least one electronic component mounted thereon. The restriction mechanism includes a substrate, a slot, at least one latch, and at least one latch restriction member. The slot allows the card to be inserted in the slot. The latch is pivotally connected to one side of the slot. The latch is rotatable between a first position in which the card is locked in the slot by the latch, and a second position in which the card is allowed to disengage from the slot. The restriction member is used to prevent the latch from being rotated to the second position.

14 Claims, 5 Drawing Sheets

RESTRICTION MECHANISM FOR CARD

CROSS-REFERENCE TO RELATED APPLICATION

This application claims the priority benefit of Taiwan application serial no. 96143028, filed on Nov. 14, 2007. The entirety of the above-mentioned patent application is hereby incorporated by reference herein and made a part of specification.

BACKGROUND OF THE INVENTION

1. Field of the Invention

The present invention generally relates to a restriction mechanism, and more particularly, to a restriction mechanism for a card.

2. Description of Related Art

A typical memory card mounting apparatus is used to mount a memory card to a circuit board such that the memory card can be electrically connected with other electronic components for data signal transmission via the circuit board.

FIG. 1A is a schematic view of a conventional memory card mounting apparatus. Referring to FIG. 1A, the conventional memory card mounting apparatus 100 includes a slot 120 and two latches 150 pivotally connected to two sides of the slot 120. A circuit board 110 is mounted to an underside of the slot 120. A memory card 130 can be inserted into the slot 120.

FIG. 1B is a schematic view of the memory card disengaged from the conventional memory card mounting apparatus. Referring to FIG. 1A and FIG. 1B, in the conventional apparatus, a push member 152 is formed on a side of a top of each latch 150 for facilitating the operation by user's fingers. A locking protrusion 154 is formed on the other side of the top of each latch 150 opposite to the push member 152, for engaging in a locking notch 156 of the memory card 130.

More specifically, in operation, the memory card 130 is firstly inserted into the slot 120. The latches 150 are rotated such that the locking protrusions 154 are engaged in the locking notches 156 of the memory card 130 to secure the memory card 130 and prevent the memory card 130 from being disengaged from the slot 120. On the other hand, if the push members 152 are pushed to rotate the latches 150 outward, the locking protrusion 154 will be disengaged from the locking notches 156 of the memory card 130, and the memory card 130 can then be removed from the slot 120.

As described above, the conventional latches are designed for easily removing the memory card from the slot and easily mounting the memory card in the slot. However, in the conventional design, gap may still exist between the locking protrusion and the locking notch. Due to this gap, the memory card cannot be stably mounted in the slot and may wobble relative to the slot or even result in a poor electrical connection. In addition, since the memory card can be easily removed from the slot merely by rotating the latches, an unauthorized person may possibly steal a large amount of memory cards in a short time. Therefore, a memory card mounting apparatus that provides good mounting effect and also increases the difficulties stealing the memory card is desired.

SUMMARY OF THE INVENTION

Accordingly, the present invention is directed to a restriction mechanism for a card that increases difficulty to remove the card and provide a stable fastening effect.

The present invention provides a restriction mechanism for a card. The card comprises at least one electronic component mounted thereon. The restriction mechanism includes a substrate, a slot, at least one latch, and at least one latch restriction member. The slot allows the card to be inserted in the slot. The latch is pivotally connected to one side of the slot. The latch is rotatable between a first position in which the card is locked in the slot by the latch, and a second position in which the card is allowed to disengage from the slot. The restriction member is used to prevent the latch from being rotated to the second position.

According to one embodiment of the present invention, the substrate is a circuit board, and the card is electrically connected to the substrate when inserted into the slot.

According to one embodiment of the present invention, the restriction member is mounted on the substrate to prevent the latch from being rotated to the second position.

According to one embodiment of the present invention, the restriction is a stop block mounted on the substrate adjacent the latch to prevent the latch from being rotated to the second position.

According to one embodiment of the present invention, the stop block is mounted on the substrate by using as least one tenon or at least one screw.

According to one embodiment of the present invention, the restriction member is mounted on the slot to prevent the latch from being rotated to the second position.

According to one embodiment of the present invention, the restriction member is a clip for clipping the latch to the slot and thus securing the latch in the first position.

According to one embodiment of the present invention, the restriction member is a locking pin, at least one locking hole is formed in one side of the slot to which the latch is pivotally connected, and the locking pin passes through the locking hole to prevent the latch from being rotated to the second position.

According to one embodiment of the present invention, the restriction member is a locking pin, at least one first locking hole is formed in one side of the slot to which the latch is pivotally connected, a second locking hole is formed in the latch corresponding to the first locking hole, and the locking pin passes through the first locking hole and the second locking hole.

According to one embodiment of the present invention, the slot is configured for the card of a memory module to be inserted in the slot.

According to one embodiment of the present invention, the card has a locking notch formed in one side thereof, the latch includes a locking protrusion formed at a top thereof, and the locking protrusion is engaged in the locking notch when the latch is rotated to the first position.

With the restriction member, when removing the card from the slot, an auxiliary tool is required to change the state of the restriction member for complete the remove, thus increasing the difficulties for unauthorized persons to steal the card. In addition, the restriction member can restrict the movement of the latch and provide a strong card fastening effect, which enables the card to be stably mounted in the slot, thus avoiding a wobble of the card or poor electrical connection.

In order to make the aforementioned and other features and advantages of the present invention more comprehensible, embodiments accompanied with figures are described in detail below.

DESCRIPTION OF THE EMBODIMENTS

Figure 1A:
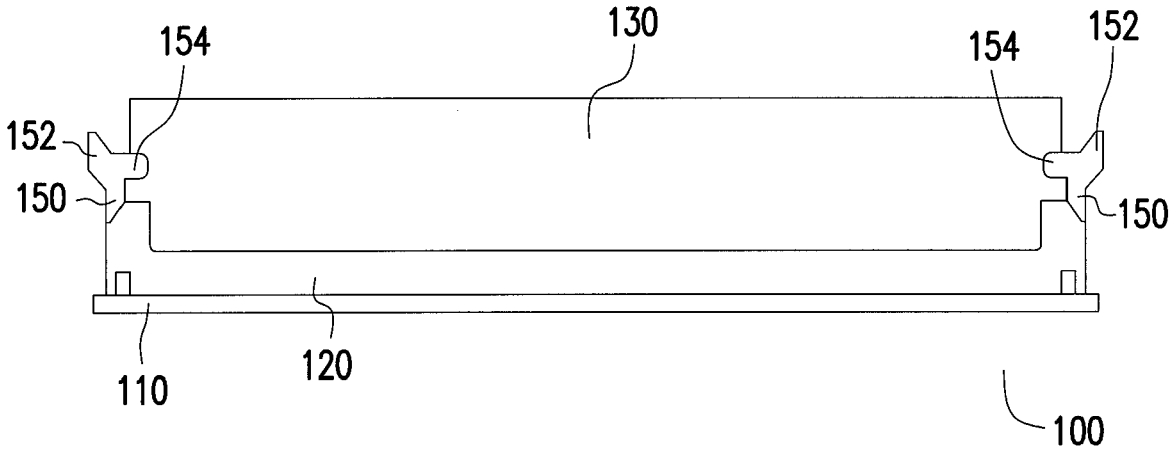
FIG. 1A (PRIOR ART)
FIG. 1A is a schematic view of a conventional memory card mounting apparatus.
Figure 1B:
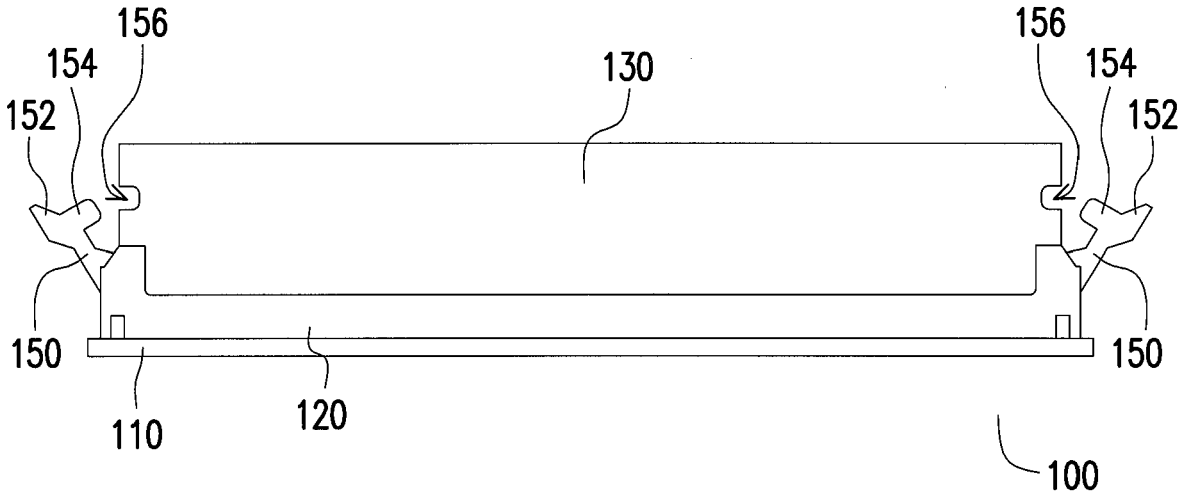
FIG. 1B (PRIOR ART)
FIG. 1B is a schematic view of the memory card disengaged from the conventional memory card mounting apparatus.
Figure 2A:
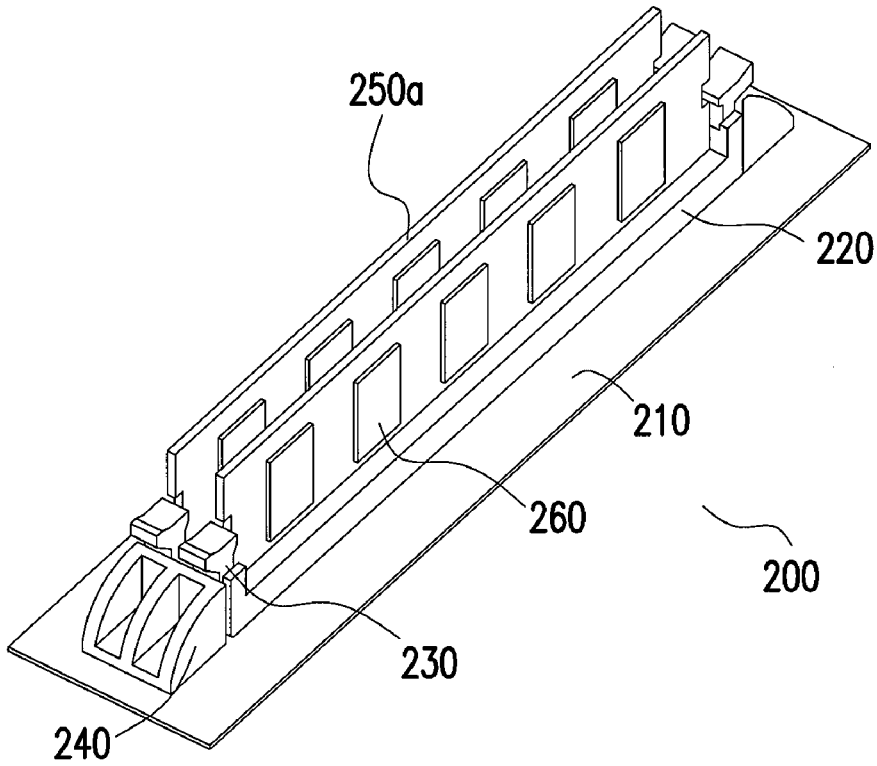
FIG. 2A is a schematic view of a restriction mechanism for a card according to a first embodiment of the present invention.

FIG. 2A is a schematic view of a restriction mechanism for a card according to a first embodiment of the present invention. Referring to FIG. 2A, in the present embodiment, the card restriction mechanism 200 includes a substrate 210, a slot 220, at least one latch 230, and at least one latch restriction member 240. The slot 220 allows a card 250*a* to be inserted in the slot. The card 250*a* includes at least one electronic component disposed thereon. The latch 230 is pivotally connected to one side of the slot 220, for mounting the card 250*a* in the slot 220. The restriction member 240 is used to prevent rotate of the latch 230, thus reliably mounting the card 250.

More specifically, the substrate 210 of the card restriction mechanism 200 may be a circuit board. When the card 250 is inserted into the slot 220, the card 250 may be electrically connected to the substrate 210. In addition, the slot 220 of the card restriction mechanism 200 allows, for example, a card of a memory module to be inserted therein. That is, the card 250*a* may be a card of a memory module. As such, when the card of the memory module is mounted on the circuit board, the memory module can be electrically connected to other cards for data transmission via the circuit board.

In addition, in another embodiment of the present invention, the substrate 210 may not have the function of electrical connection. The card restriction mechanism 200 is only used to restrict the card 250*a* in the slot 220 disposed on the substrate 210.

Figure 2B:
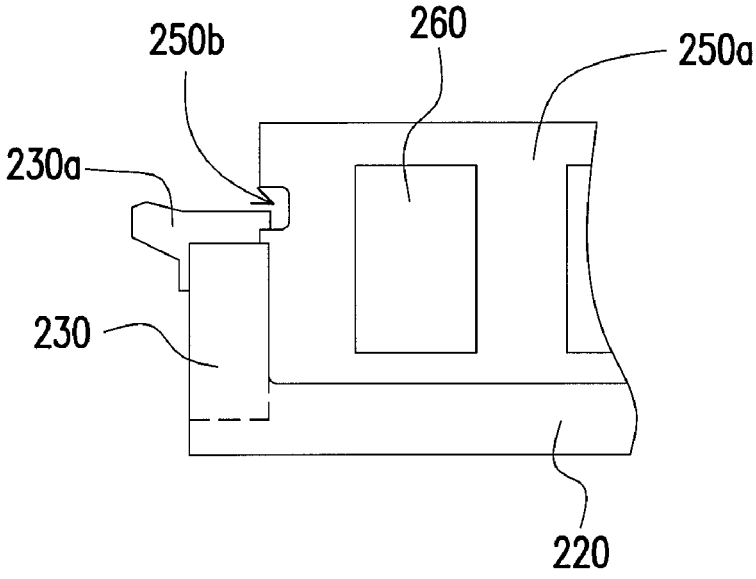
FIG. 2B is an enlarged partial view of the latch of FIG. 2A rotated to a first position.
Figure 2C:
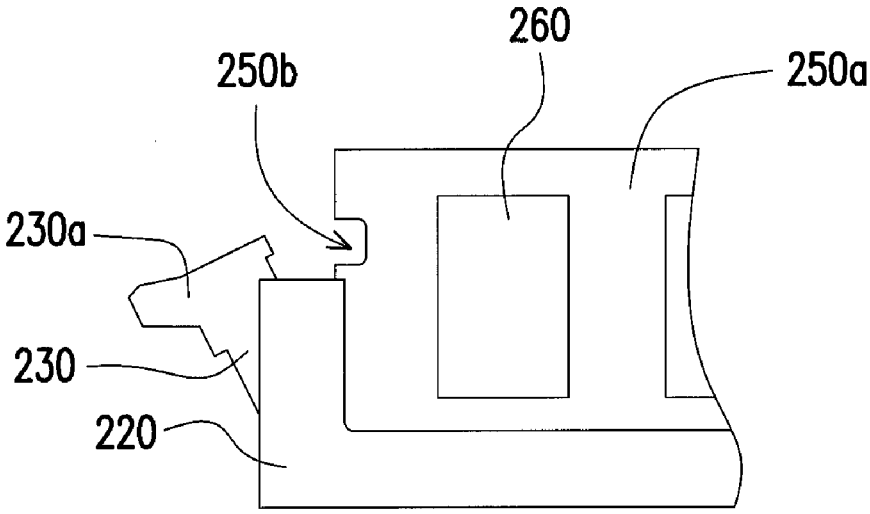
FIG. 2C is an enlarged partial view of the latch of FIG. 2A rotated to a second position.

FIG. 2B is an enlarged partial view of the latch of FIG. 2A rotated to a first position, and FIG. 2C is an enlarged partial view of the latch of FIG. 2A rotated to a second position. Referring to FIGS. 2B and 2C, in the present embodiment, the card 250 has a locking notch 250*b* in one side thereof. The latch 230 includes a locking member 230*a* formed on a top thereof. When the latch 230 of the card restriction mechanism 200 is rotated to the first position, the locking member 230*a* is engaged into the locking notch 250*b* to lock the card 250*a* in the slot 220, thus mounting the card 250*a* in the slot 220. When the latch 230 is rotated to the second position, the locking member 230*a* is disengaged from the locking notch 250*b* to disengage the card 250 from the slot 220, thus allowing the card 250 to be removed from the slot 220.

Figure 2D:
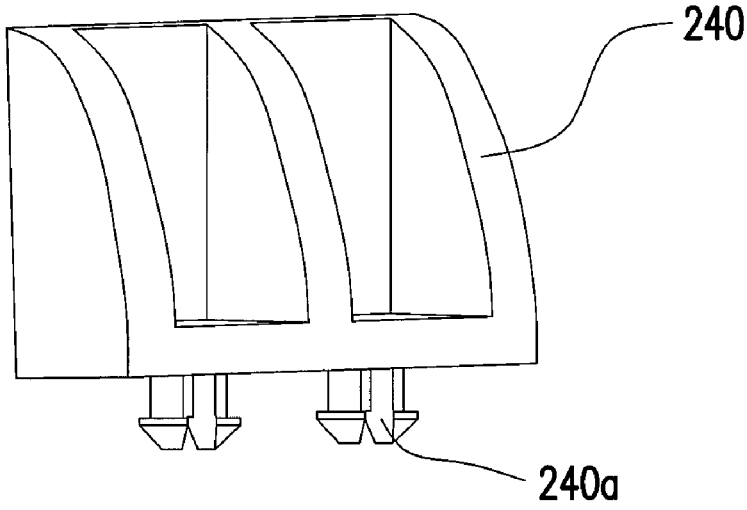
FIG. 2D is an enlarged partial view of the restriction member of FIG. 2A.

FIG. 2D is an enlarged partial view of the restriction member of FIG. 2A. Referring to FIGS. 2A and 2D, in the present embodiment, the restriction member 240 is a stop block positioned on the substrate 210 adjacent the latch 230. The stop block is used to prevent the latch 230 from being rotated to the second position. More specifically, the stop block is mounted to the substrate 210 by using at least one tenon 240*a* or at least one screw (two tenones 240*a* are illustrated in FIG. 2D). An auxiliary tool is required to remove the restriction member 240 from the substrate 210 before removing the card 250*a* from the slot 220. Therefore, the difficulties are increased for possible unauthorized persons to steal the card 250*a*.

Figure 3A:
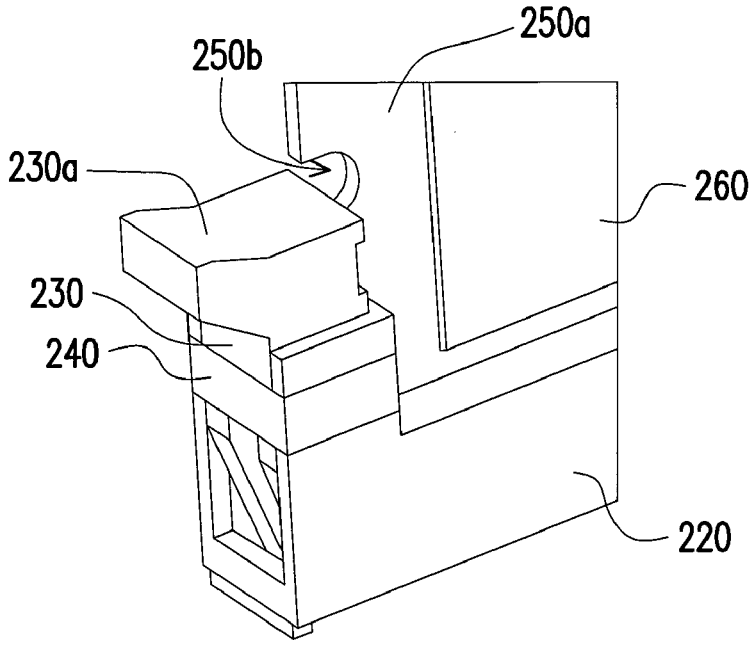
FIG. 3A is a schematic view of the card restriction mechanism according to a second embodiment of the present invention.
Figure 3B:
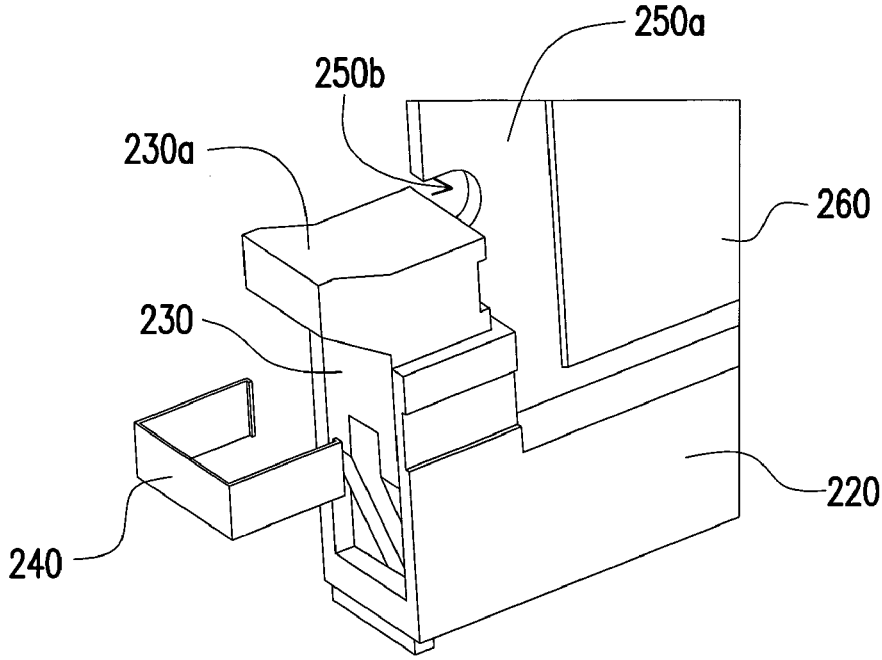
FIG. 3B is a schematic view of the restriction member of FIG. 3A being disengaged.

FIG. 3A is a schematic view of the card restriction mechanism according to a second embodiment of the present invention. FIG. 3B is a schematic view of the restriction member of FIG. 3A being disengaged. Referring to FIGS. 3A and 3B, the present embodiment is similar to the first embodiment except that, in the present embodiment, the restriction member 240 is a clip mounted to the slot 220. The clip device is used to clip the latch 230 on the slot 220 such that the latch 230 is mounted in the first position and prevented from being rotated to the second position.

More specifically, the restriction member 240 may be of the shape of the symbol "ㄇ", and can be used to restrict the movement of the latch 230. The restriction member 240 can be provided to make the restriction member 240 cannot be manually removed easily. In the present embodiment, the restriction member 240 clips the latch 230 to the slot 220 and positions the latch 230 in the first position, thus preventing the latch 230 from being freely rotated and hence reliably mounting the card 250*a*. An auxiliary tool is required to remove the restriction member 240 from the slot 220 before removing the card 250*a* from the slot 220. Therefore, the difficulties are increased for possible unauthorized persons to steal the card 250*a*.

Figure 4:
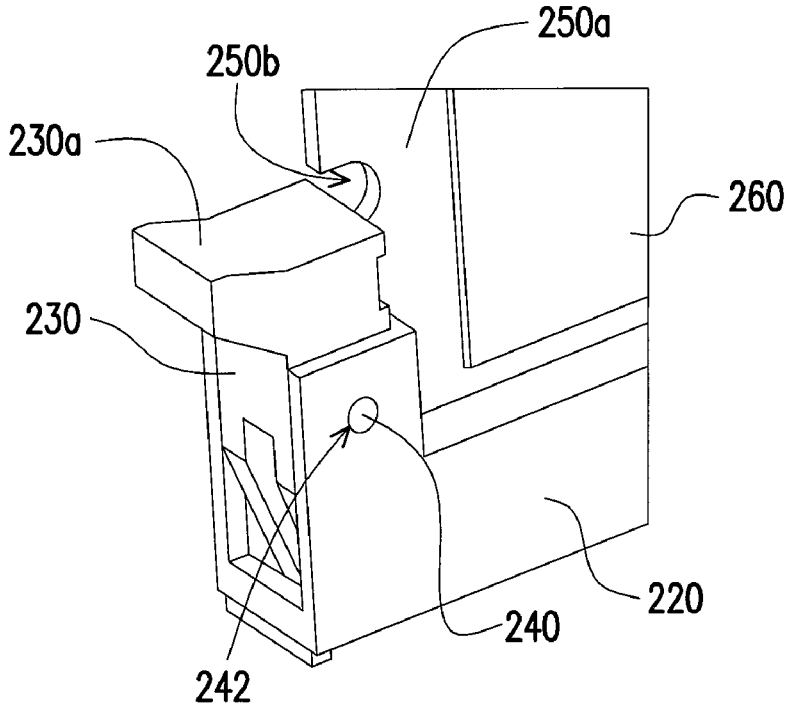
FIG. 4 is a schematic view of a card restriction mechanism according to a third embodiment of the present invention.

FIG. 4 is a schematic view of a card restriction mechanism according to a third embodiment of the present invention. Referring to FIG. 4, the present embodiment is similar to the first embodiment except that, in the present embodiment, the restriction member 240 is a locking pin mounted in the slot 220. At least one first locking hole 242 is formed in the side of the slot 220 to which the latch 230 is pivotally connected, and a second locking hole (not shown) is formed in the latch 230 corresponding to the first locking hole 242. The locking pin passes through the first locking hole 242 and the second locking hole.

More specifically, in the present embodiment, the restriction member 240 may be cylindrical in shape. The restriction member 240 extends through the first locking hole 242 in the side of the slot 220 and the second locking hole of the latch 230 to thereby stably mount the slot 220 and the latch 230 together. Therefore, the latch cannot be freely rotated to the second position, thus reliably mounting the card 250*a*. An auxiliary tool is required to remove the restriction member 240 from the slot 220 before removing the card 250*a* from the slot 220. Therefore, the difficulties are increased for possible unauthorized persons to steal the card 250*a*.

Figure 5:
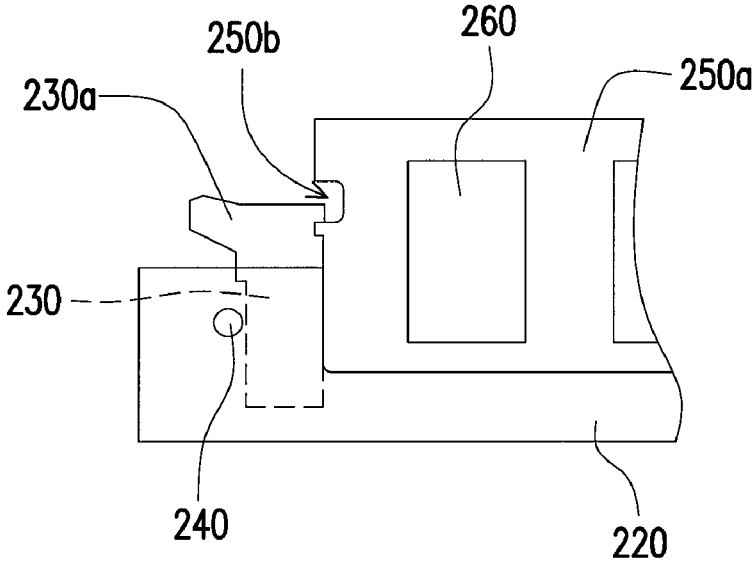
FIG. 5 is a schematic view of a card restriction mechanism according to a fourth embodiment of the present invention.

FIG. 5 is a schematic view of a card restriction mechanism according to a fourth embodiment of the present invention. Referring to FIG. 5, the present embodiment is similar to the third embodiment except that, in the present embodiment, the restriction member 240 is a locking pin mounted on the slot 220. At least one locking hole is formed in the side of the slot 220 to which the latch 230 is pivotally connected. The locking pin passes through the locking hole to prevent the latch 230 from being rotated to the second position.

More specifically, in the present embodiment, the restriction member 240 is a locking pin. The position of the locking pin can restrict the range of movement of the latch 230. For example, when the restriction member 240 is disposed to abut against the latch 230, the restriction member 240 will completely restrict the latch 230 such that the latch 230 can only stay in the first position and cannot move. However, in another embodiment, the restriction member 240 can also be disposed adjacent the latch 230 without contacting the latch 230 as long as the latch 230 can restrict the card 250*a* from being moved. The restriction member 240 is used to provide a strong fastening effect to the card 250*a*. An auxiliary tool is required to remove the restriction member 240 from the slot 220 before removing the card 250*a* from the slot 220. Therefore, the difficulties are increased for possible unauthorized persons to steal the card 250*a*.

In summary, the present invention has at least the following features and advantages:

(1) Due to the restriction member, the conventional problem that the card can be easily removed merely by rotating the latch is overcome, thus increasing the difficulties for the unauthorized persons to steal the card.

(2) Due to the restriction member, in assembly or removal of the restriction mechanism of the card, an auxiliary tool is required to remove the restriction member from the substrate or the slot, thus increasing the difficulties for the unauthorized persons to steal the card.

(3) The restriction member can restrict the movement of the latch and provide a strong card fastening effect, which enables the card to be stably mounted in the slot, thus avoiding the wobble of the card or poor electrical connection.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A restriction mechanism for a card, the card comprising at least one electronic component mounted thereon, the restriction mechanism comprising:

a substrate;

a slot used for the card to be inserted;

at least one latch pivotally connected to one side of the slot, the latch being rotatable between a first position in which the card is locked in the slot by the latch, and a second position in which the card is allowed to disengage from the slot; and at least one restriction member being mounted on the substrate to prevent the latch from being rotated to the second position.

2. The restriction mechanism for the card according to claim 1, wherein the substrate is a circuit board, and the card is electrically connected to the substrate when inserted into the slot.

3. The restriction mechanism for the card according to claim 1, wherein the restriction is a stop block mounted on the substrate adjacent the latch to prevent the latch from being rotated to the second position.

4. The restriction mechanism for the card according to claim 3, wherein the stop block is mounted on the substrate by using as least one tenon or at least one screw.

5. The restriction mechanism for the card according to claim 1, wherein the slot is configured for the card of a memory module to be inserted in the slot.

6. The restriction mechanism for the card according to claim 1, wherein the card has a locking notch formed in one side thereof; and a locking protrusion formed at a top of the latch and being engaged in the locking notch when the latch is rotated to the first position.

7. A restriction mechanism for a card, the card comprising at least one electronic component mounted thereon, the restriction mechanism comprising:

a substrate;

a slot used for the card to be inserted;

at least one latch pivotally connected to one side of the slot, the latch being rotatable between a first position in which the card is locked in the slot by the latch, and a second position in which the card is allowed to disengage from the slot; and at least one restriction member being mounted on the substrate to prevent the latch from being rotated to the second position, wherein the restriction member is a locking pin, at least one locking hole is formed in one side of the slot to which the latch is pivotally connected, and the locking pin passes through the locking hole to prevent the latch from being rotated to the second position.

8. The restriction mechanism for the card according to claim 7, wherein the substrate is a circuit board, and the card is electrically connected to the substrate when inserted into the slot.

9. The restriction mechanism for the card according to claim 7, wherein the slot is configured for the card of a memory module to be inserted in the slot.

10. The restriction mechanism for the card according to claim 7, wherein the card has a locking notch formed in one side thereof; and a locking protrusion formed at a top of the latch and being engaged in the locking notch when the latch is rotated to the first position.

11. A restriction mechanism for a card, the card comprising at least one electronic component mounted thereon, the restriction mechanism comprising:

a substrate;

a slot used for the card to be inserted;

at least one latch pivotally connected to one side of the slot, the latch being rotatable between a first position in which the card is locked in the slot by the latch, and a second position in which the card is allowed to disengage from the slot; and at least one restriction member being mounted on the substrate to prevent the latch from being rotated to the second position, wherein the restriction member is a locking pin, at least one first locking hole is formed in one side of the slot to which the latch is pivotally connected, a second locking hole is formed in the latch corresponding to the first locking hole, and the locking pin passes through the first locking hole and the second locking hole.

12. The restriction mechanism for the card according to claim 11, wherein the substrate is a circuit board, and the card is electrically connected to the substrate when inserted into the slot.

13. The restriction mechanism for the card according to claim 11, wherein the slot is configured for the card of a memory module to be inserted in the slot.

14. The restriction mechanism for the card according to claim 11, wherein the card has a locking notch formed in one side thereof; and a locking protrusion formed at a top of the latch and being engaged in the locking notch when the latch is rotated to the first position.

* * * * *